United States Patent [19]

Nissen

[11] 4,010,576

[45] Mar. 8, 1977

[54] APPARATUS FOR REBEVELING SPIRAL KNIVES

[76] Inventor: Roland N. Nissen, 112 N. Meridan, Valley Center, Kans. 67147

[22] Filed: June 23, 1975 (Under Rule 47)

[21] Appl. No.: 589,369

[52] U.S. Cl. ..... 51/249; 56/250

[51] Int. Cl.[2] ..... B24B 3/42

[58] Field of Search ..... 51/33 K, 34 A, 36, 47, 51/55, 249; 56/250; 83/174.1; 76/82.1; 241/101.2

[56] References Cited

UNITED STATES PATENTS

| | | | |
|---|---|---|---|
| 3,581,446 | 6/1971 | Witt | 51/249 |
| 3,638,363 | 2/1972 | Witt | 51/249 |
| 3,831,325 | 8/1974 | Joray | 51/249 |

*Primary Examiner*—Al Lawrence Smith
*Assistant Examiner*—Nicholas P. Godici
*Attorney, Agent, or Firm*—Schmidt, Johnson, Hovey & Williams

[57] ABSTRACT

The helically oriented knives of a cutting reel, such as found in forage harvesters, may be sharpened by reciprocating a sharpening stone along the beveled cutting edge of each knife. The reel is held against rotation when the knife to be sharpened has been disposed in its proper position relative to the stone, whereupon the stone is shifted back and forth along the beveled edge while at the same time rocked automatically to-and-fro in a direction transverse to the edge such that the curvature of the knife is automatically compensated for to maintain the stone in continuous engagement with the edge. Followers mounted on the stone ride along an arcuate guide rod conforming to the helical orientation of the knives to provide the required rocking of the stone as the latter is reciprocated.

10 Claims, 7 Drawing Figures

APPARATUS FOR REBEVELING SPIRAL KNIVES

This invention relates to the sharpening of spirally or helically oriented knives such as are typically found on the cutting reel of a forage harvester wherein a crop being harvested is passed through the cutting reel operating at relatively high speeds to disintegrate the crop. These knives require frequent sharpening to maintain their beveled edges in the best condition to sever the crop with the least horsepower requirements and to maintain a smooth cutting operation free of frequent clogging and jam-ups. However, because of the helically disposed nature of such knives, it is difficult to maintain a sharpening stone in the precisely proper position as it is moved along the knife edges to rebevel or sharpen the same.

Many previous arrangements have been developed to carry out the sharpening process while maintaining the stone properly engaged with the helical edges of the knives, and a number of such arrangements have involved advancing the sharpening stone back and forth across the periphery of the cutting reel along a path of travel parallel to its axis of rotation while simultaneously causing the freely rotatable reel to rotate slightly fore-and-aft in order to bring successive points along the helical knife edge into engagement with the stone as the latter is reciprocated in a straight line. In this manner, the position of the stone along the length of the reel is automatically coordinated with the fore-and-aft disposition of the helical knife edge to maintain the stone properly engaged with the beveled edge at each point along its length.

Such previous arrangements require, however, that the cutting reel be completely disconnected from its drive source during the sharpening process such that the reel can be sufficiently free-wheeling to respond to efforts to automatically rotate the reel into proper engagement with the stone as the latter is reciprocated. In some situations, such disengagement of the reel may be unduly complicated and time-consuming, such as on many self-propelled forage harvesters, and thus an arrangement as aforesaid wherein the reel makes the necessary compensating motion to maintain the stone in continuous engagement with the knife edge being sharpened may not be acceptable.

Accordingly, it is one important object of the present invention to provide apparatus for sharpening the edges of helically disposed knives wherein the compensating movement necessary to maintain the stone in proper engagement with the helically extending knife edge is made by the stone itself rather than the knife such that the latter may remain stationary during the sharpening process without requiring what may be a time-consuming and difficult task of disconnecting the cutting reel from its drive source.

More particularly, an important object of this invention is to mount the sharpening stone not only for reciprocation along the length of each knife but also for rocking movement about the axis of rotation of the reel such that as the stone is moved along the knife edge it may be swung in the appropriate direction and in the amount necessary to always maintain the stone in beveling engagement with the edge.

A further important object of the instant invention is to provide means other than the knives themselves to serve as the camming surface which guides the stone in its rocking movement during reciprocation, thereby providing an independent, precise means of rocking the stone in exactly the same manner and to precisely the same extent with each knife presented for sharpening so as to produce sharpened edges of uniform beveling on all knives of the reel.

An additional important object of this invention is the provision of means for readily positioning and maintaining each blade successively in a properly indexed position for sharpening by the stone.

Figure 1:
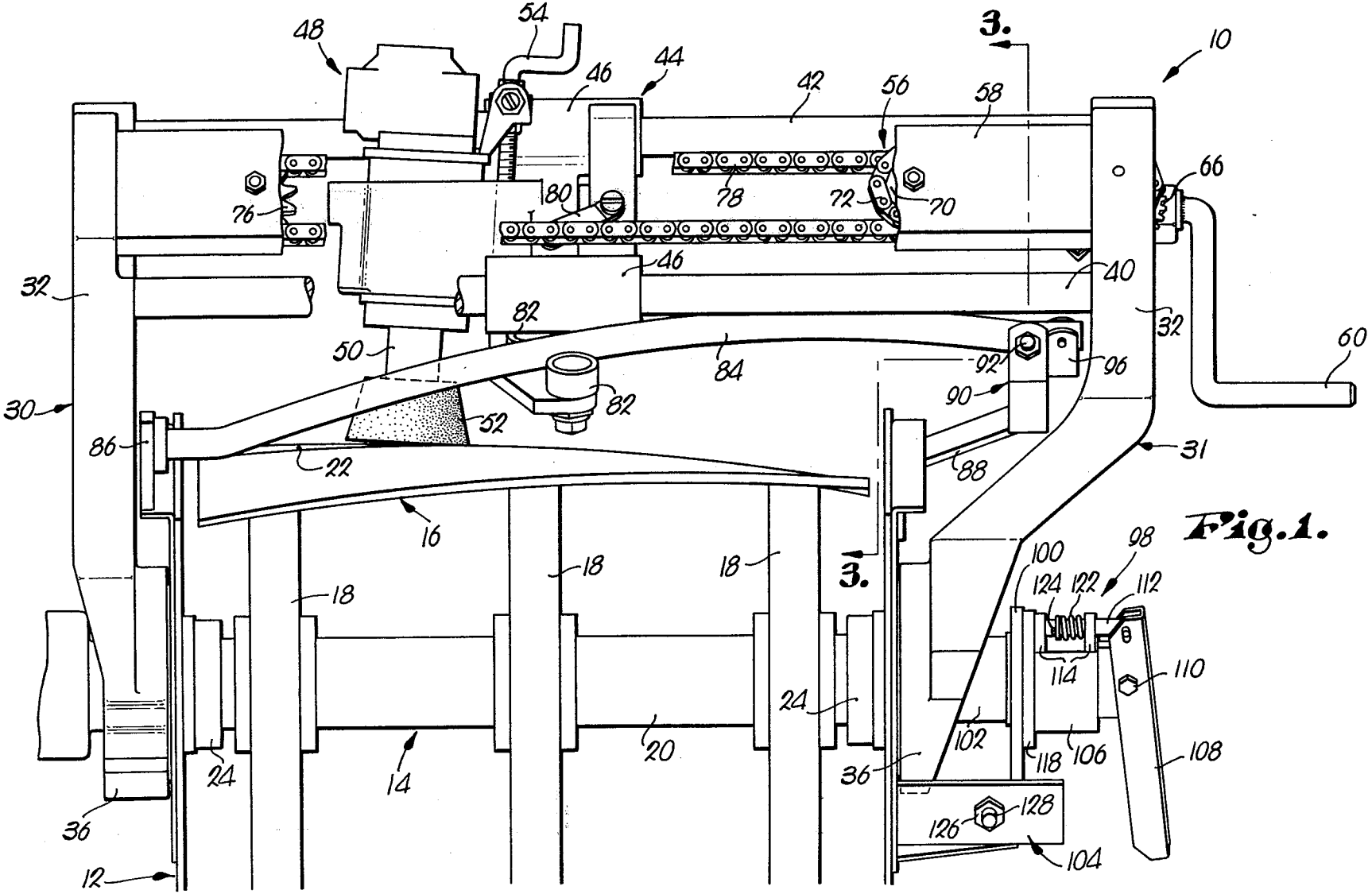
FIG. 1 is a rear elevational view of a helically knived cutting reel employing sharpening or rebeveling apparatus constructed in accordance with the principles of the present invention, parts being broken away to reveal details of construction.
Figure 2:
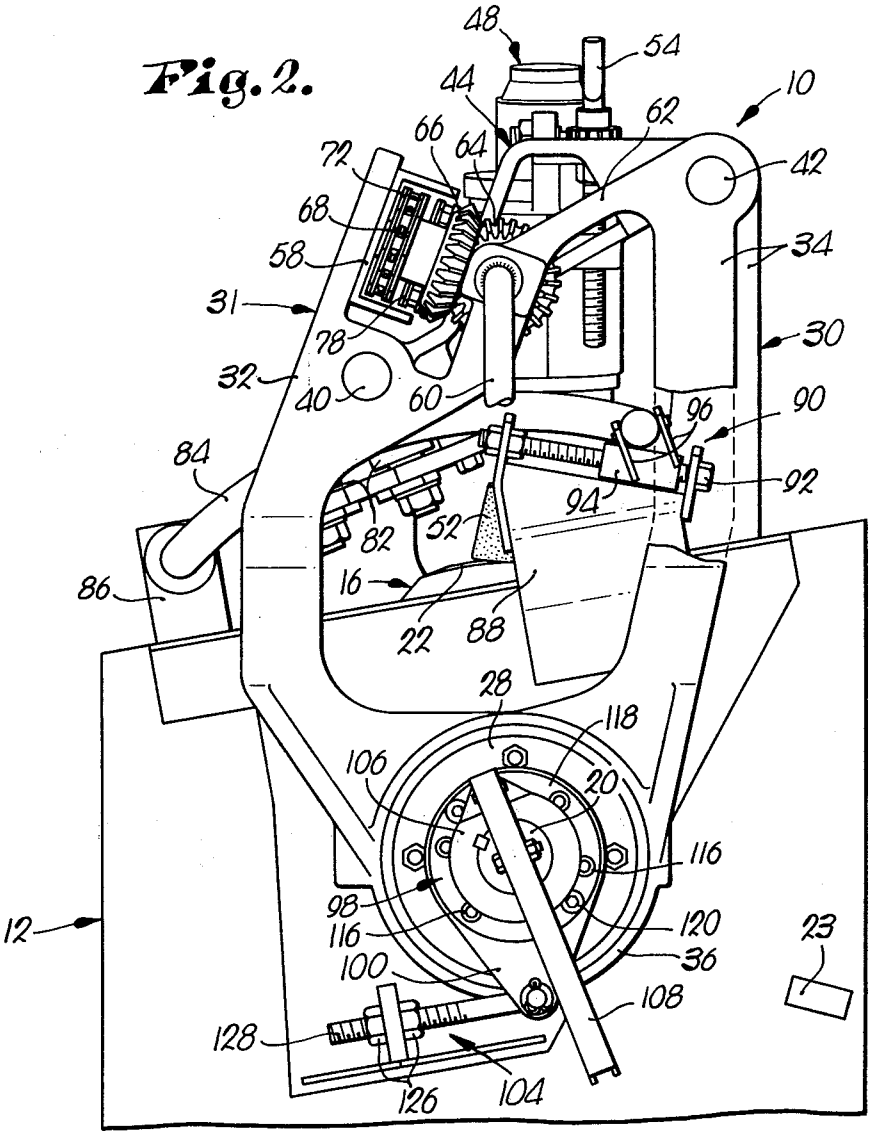
FIG. 2 is an elevational view of the right end of the reel and apparatus (viewing FIG. 1), parts again being broken away to reveal details of construction.
Figure 3:
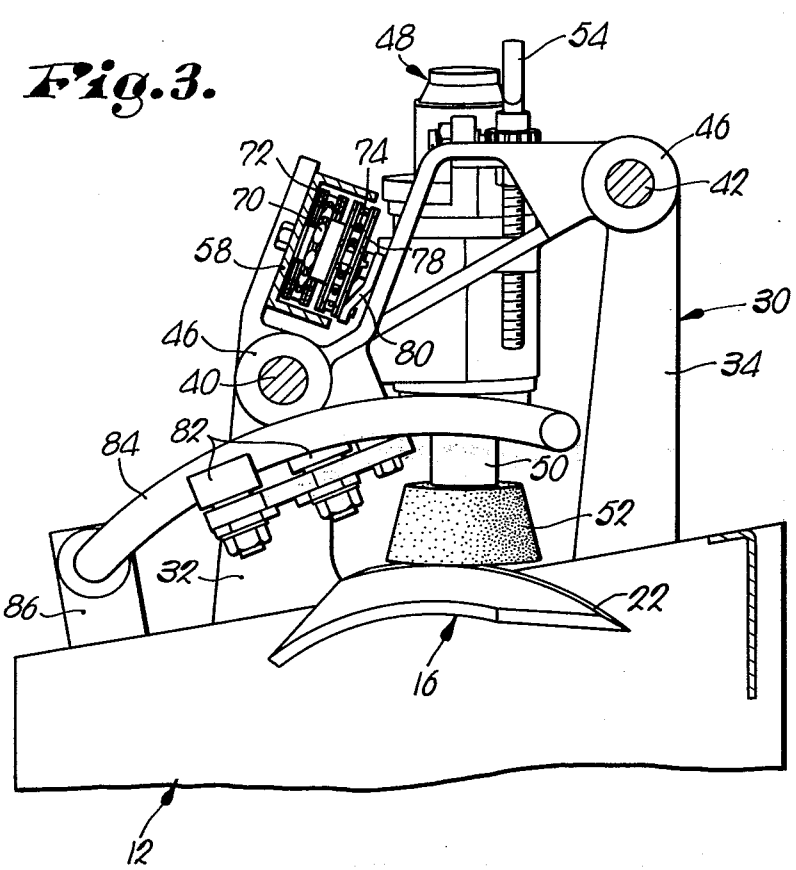
FIG. 3 is a cross sectional view through the apparatus taken substantially along line 3—3 of FIG. 1.
Figure 5:
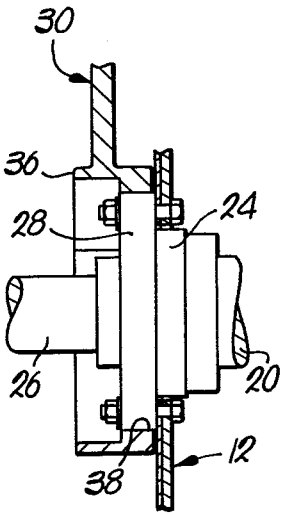
FIG. 5 is a cross-sectional view of the bearing structure adjacent one end of the apparatus taken along line 5—5 of FIG. 4.

The sharpening or rebeveling apparatus 10 is mounted on the housing 12 containing a cutting reel 14 having a number of knives 16 (one only being shown) supported about the periphery of reel 14 by spiders 18 spaced along a shaft 20. Each knife 16 extends longitudinally of the reel 14 in a helical orientation, having a beveled or sharpened leading edge 22 along its length which is disposed to cooperate with a stationary shear bar 23 for severing crops presented to reel 14 into relatively short lengths. Viewing FIGS. 2 and 3, the direction of rotation of reel 14 is clockwise with the edge 22 of each knife 16 leading. The shaft 20 is supported at its opposite ends by bearings 24 (detailed in FIG. 5), and the left end of shaft 20 (viewing FIG. 1) is coupled by suitable means to a drive shaft 26 leading to a source of driving power (not shown) for the reel 14.

Each bearing 24 is provided with an outermost member 28 (FIG. 5) which is bolted to the proximal sidewall of housing 12 such as to remain stationary during rotation of reel 14, and the peripheries of members 28 serve as bearing surfaces for a pair of similar, large bracket structures 30 and 31, each having a pair of upright legs 32 and 34 that are outwardly offset in the case of bracket 31. The lower ends of each pair of legs 32 and 34 converge to a boss 36 having a central opening 38 that receives the bearing member 28 so as to adapt the brackets 30 and 31 for rocking movement about the axis of shaft 20 in a fore-and-aft direction relative to the rotation of reel 14.

The bifurcated legs 32 and 34 of brackets 30 and 31 receive a pair of straight guide rod structures 40 and 42 which span the housing 12 and tie the two brackets 30 and 31 together for swinging movement in unison. The rear, lower rod 40 interconnects the rear legs 32, while the upper, forwardly disposed rod 42 interconnects front legs 34. Shiftable along the two rods 40 and 42 is a carriage 44 provided with apertured bosses 46 that slidably receive the two rods 40 and 42.

A sharpening or beveling element in the nature of an electrically powered grinder 48 is supported by carriage 44 for reciprocation between brackets 30 and 31 along guide rods 40 and 42. The drive shaft 50 of grinder 48 projects downwardly therefrom and carries a generally frustoconical stone 52 which may be brought downwardly into engagement with the beveled edge 22 of an adjacent knife 16 by operating a hand crank 54 to shift grinder 48 relative to carriage 44 in a conventional manner.

Figure 4:
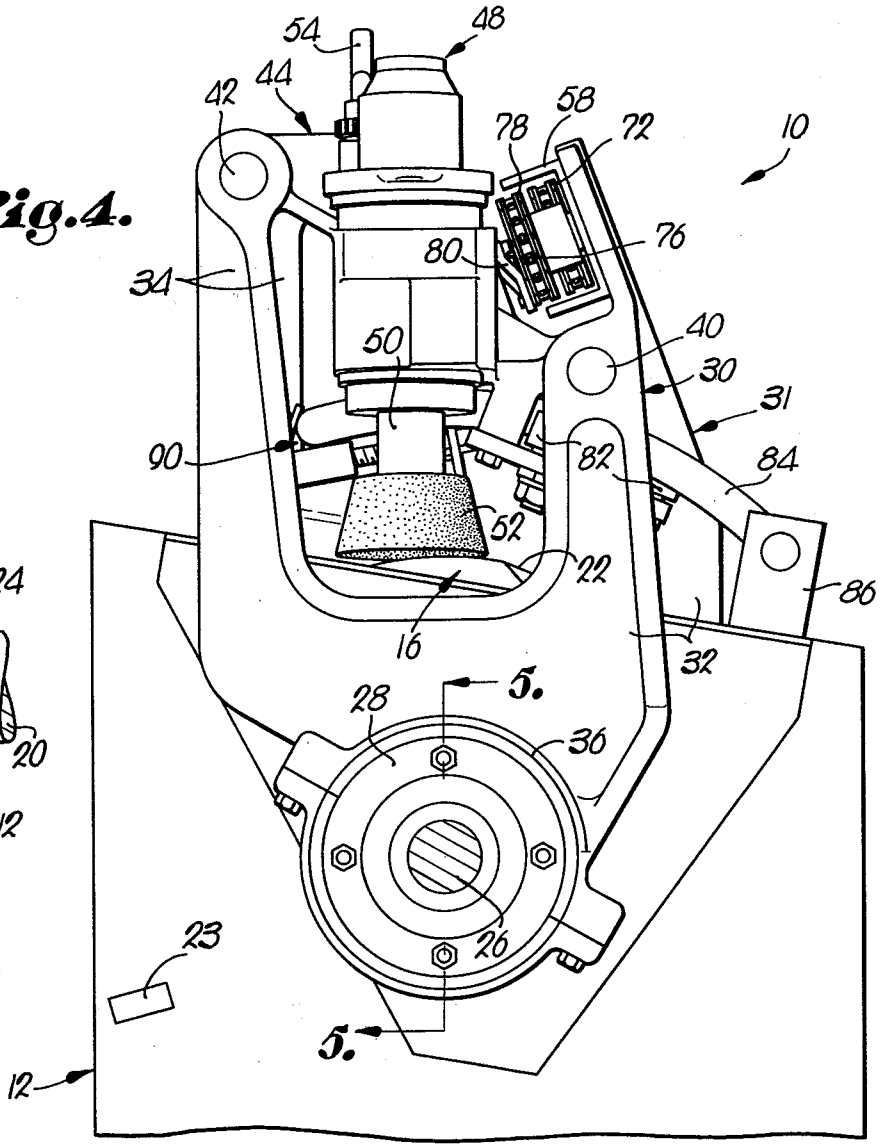
FIG. 4 is a vertical cross-sectional view taken outside of the opposite end of the reel and apparatus.

Reciprocation of the carriage 44 and grinder 48 along rods 40 and 42 is accomplished by a chain and sprocket mechanism 56 normally concealed beneath a U-shaped shield 58 (broken away in FIG. 1) that is secured to and extends between the legs 32 of brackets 30 and 31. Mechanism 56 includes a hand crank 60 rotatably supported on a web 62 that extends between legs 30 and 34 of bracket 31, a pair of intermeshing bevel gears 64 and 66 (FIG. 2) carried on a crank 60 and shield 58 respectively, a first sprocket 68 mounted for rotation with gear 66 on shield 58, a second sprocket 70 (FIGS. 1, 3 and 4) mounted beside sprocket 68 on shield 58 and drivingly coupled with sprocket 68 through a short endless chain 72, a third sprocket 74 (FIG. 3) mounted for rotation with sprocket 70 on shield 58, a fourth sprocket 76 (FIGS. 1 and 4) mounted on shield 58 adjacent bracket 30, and a long, endless drive chain 78 drivingly interconnecting sprockets 74 and 76. By this arrangement, the input power supplied by rotating crank 60 is transmitted ultimately to the endless chain 78 such that the latter travels in an endless loop back and forth across housing 12. A link 80 pivotally interconnecting carriage 44 and long chain 78 transmits motion from chain 78 to carriage 44 for shifting of the latter and, as is conventional, link 80 is adapted to move around sprockets 74 and 76 at opposite ends of the path of travel of carriage 44 such that crank 60 may be operated on a continuous basis as the carriage 44 automatically reverses itself at opposite ends of its path of travel.

In order to maintain the stone 52 properly engaged with knife edge 22 during reciprocation of carriage 44 and grinder 48 along rods 40 and 42, the carriage 44 is provided with follower means in the nature of a pair of spaced rollers 82 which receive an arcuate guide rod 84 therebetween. The rod 84 is secured at its opposite ends to housing 12 through a pair of mounts 86 and 88 and is stationary during reciprocation of carriage 44 and grinder 48 so as to cause the entire assembly 30, 31, 40, 42, 44, 48 and 82 to rock back and forth about the axis of shaft 20 when crank 60 is operated. Rod 84 is concentric to shaft 20 and knives 16 and is oriented helically to the same extent as knives 16. Mount 88 on the right side of housing 12 viewing FIG. 1 includes an adjustment assembly 90 which enables the helical orientation of rod 84 to be varied slightly as necessary to conform to the orientation of knives 16. In particular, assembly 90 includes a bolt 92 having an internally threaded component 94 which is shiftable along bolt 92 when the latter is rotated, and component 94 carries a pair of depending ears 96 from the proximal end of rod 84 such that upon shifting of component 94 along bolt 92, the attitude of rod 84 may be varied slightly. Preferably, bolt 92 is inclined upwardly and rearwardly as illustrated best in FIG. 2.

It is important that the knife 16 to be sharpened is properly disposed relative to stone 52 before the sharpening procedure is commenced. To accomplish this, an indexing mechanism 98 is provided adjacent the bracket 31 to hold shaft 20 in any one of a number of selected positions chosen to place a selected knife 16 in proper relationship to stone 52. The indexing mechanism 98 includes a generally teardrop-shaped plate 100 which encircles a hub 102 on an extension of shaft 20 and is maintained in a stationary condition at all times by a retaining assembly 104 secured to the proximal sidewall of housing 12. An annular support 106 on the outside of plate 100 is connected through means not shown with hub 102 such as to present a unitary structure, and support 106 is keyed to the outermost end of shaft 20 for movement therewith when the latter is forcibly rotated. A lever 108 pivoted intermediate its ends at 110 to support 106 has a locking pin 112 at one end that extends through a pair of lugs 114 of support 106 and into any one of a number of holes 116 in a second plate 118 bolted against the outer face of the stationary plate 100. The bolts 120 which secure plate 118 against plate 100 are recessed below the outer face of plate 118 to provide clearance for the innermost lug 100 of support 106 when the latter is rotated, and in the embodiment illustrated, six holes 116 are provided, spaced 60° apart in order to correspond to six knives 16 on the reel 14. A short coil spring 122 between lugs 114 bears against a projection 124 on pin 112 to yieldably bias the latter into locking engagement with a selected hole 116 of plate 118.

From the foregoing detailed description, the manner of using apparatus 10 should be readily apparent. Most of the apparatus 10 is designed to remain permanently in place upon housing 12, but the indexing mechanism 98 is utilized only at the time sharpening is desired. Hence, when knives 16 require sharpening, the indexing mechanism 98 is slipped onto the exposed outermost end of shaft 20 as a unit and the retaining assembly 104 is made secure to the proximal sidewall of housing 12 through the double nuts 126. Adjustment of nuts 126 along the bolt 128 of retaining assembly 104 positions the teardrop plate 100 and the overlying plate 118 with holes 116 in the proper location relative to the sharpening position for each knife 16.

The reel 14, still connected to its drive source through a transmission, may then be manually rotated with some resistance after depressing lever 108 to withdraw pin 112 from a hole 116, and such rotation continues until such time as the first knife 16 to be sharpened is brought to the top of housing 12 into the proper sharpening position, whereupon pin 112 will pop into the corresponding hole 116. In this condition, the reel 14 is firmly held against further rotation, and sharpening may commence.

Figure 6:
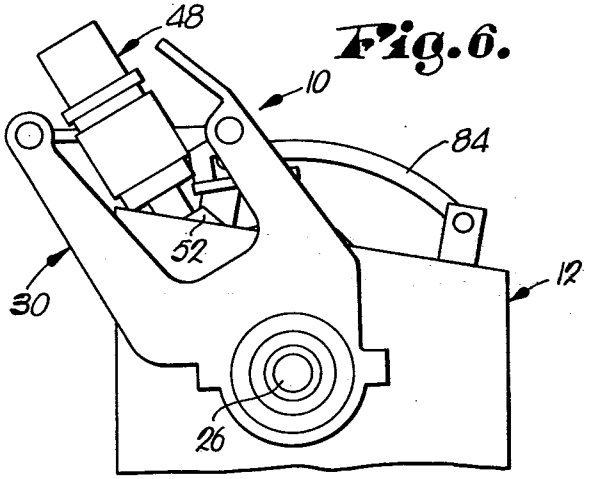
FIGS. 6 and 7 are schematic views on a reduced scale showing the apparatus rocked to its opposite extreme positions during the sharpening procedure.
Figure 7:
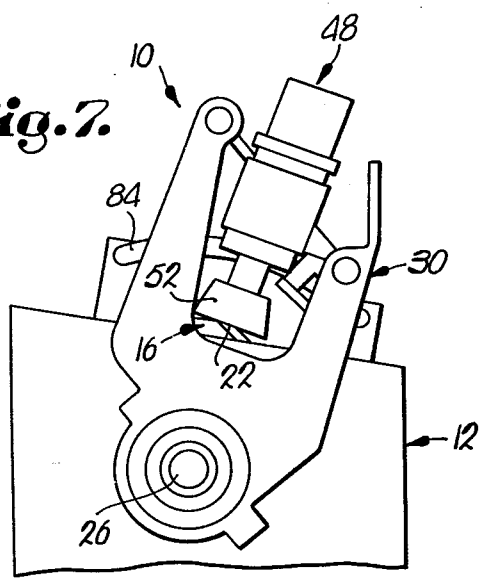

As the crank 60 is rotated, the carriage 44 and grinder 48 move out of a stored position from outside housing 12 adjacent bracket 31 until the stone 52 engages the bevel edge 22. Assuming that further adjustment of the height of stone 52 is not required through crank 54, continued operation of hand crank 60 shifts the carriage 44 and grinder 48 back and forth along rods 40 and 42, while at the same time the following rollers 82 riding along guide rod 84 force the brackets 30 and 31 to rock fore-and-aft about the axis of shaft 20 between the two extremes shown in FIGS. 6 and 7. Because the guide rod 84 is oriented helically to correspond to the orientation of knives 16, the rocking motion of brackets 30 and 31 is only to that extent necessary to maintain stone 52 firmly in engagement with edge 22 as carriage 44 and grinder 48 continue to be reciprocated. Hence, the compensating motion required to maintain stone 52 in firm engagement with edge 22 is provided not by reel 14 but rather by grinder 48, and such compensating motion is at all times under the strict control of rollers 82 on rod 84.

After sufficient passes have been taken along the first knife 16, lever 108 is depressed to withdraw pin 112 from the corresponding hole 116, whereupon the reel 14 can be rotated to such extent necessary to bring the next knife 16 into sharpening position. When the next knife 16 has been brought to the proper position at the top of housing 12, the spring loaded pin 112 pops into the corresponding hole 116 to firmly locate and hold reel 14 against further rotation. The same sharpening procedure described above may then be utilized on such new knife 16 by simply rotating crank 60 a sufficient number of turns to cause stone 52 to make several passes along the beveled edge 22 to sharpen the same properly.

It is to be understood that the following rollers 82, or their equivalent, could be directed along any appropriately configured surface which provided a course of travel for the rollers 82 corresponding to the helical orientation of the knives 16. The rollers 82 could, therefore, utilize one of the knives 16 as their camming or guiding surface rather than rod 84, provided that the rollers 82 were so arranged that they would not in anyway interfere with action of the stone 52. However, having the independent helical guide rod 84 utilized to control movement of the rollers 82 is advantageous in that it assures that the stone 52 will always be returned to precisely the same position for all knives 16, thereby providing a uniform sharpening action that would not necessarily be possible if the individual knives 16 were utilized as the guide means for rollers 82.

I claim:

1. In combination with a cutting reel having a plurality of elongated knives extending helically about the periphery of the reel and presenting longitudinal cutting edges disposed transversely of the direction of rotation of the reel, apparatus for sharpening said edges including:

swingable support structure mounted for swinging movement about the axis of rotation of the reel;

a sharpener mounted on said structure for reciprocation relative to said structure transversely of the direction of swinging movement of the structure and adjacent the periphery of the reel; and follower means coupled with said sharpener for reciprocation therewith, said structure rocking about said axis during reciprocation of the sharpener in response to guiding of said follower means along a helical course of travel conforming to the orientation of said knives, thereby permitting the sharpener to remain properly engaged with the edge of an adjacent knife as the sharpener is reciprocated.

2. Apparatus as claimed in claim 1, wherein said follower means is provided with a helical guide spaced from the reel and defining said course of travel of the follower means.

3. Apparatus as claim in claim 2, wherein said guide is provided with means for selectively varying the orientation thereof relative to said knives.

4. Apparatus as claimed in claim 3, wherein said guide includes an arcuate rod extending transversely of the direction of rotation of said reel, said follower means including a pair of rollers receiving said rod therebetween.

5. Apparatus as claimed in claim 1, wherein said reel is provided with means releasably holding the same against rotation and in a selected position for sharpening.

6. Apparatus as claimed in claim 1, wherein said reel includes a central shaft supporting said knives, said structure being swingable on said shaft.

7. Apparatus as claimed in claim 6, wherein said shaft is provided with indexing means for releasably holding the shaft in any one of a number of selected, rotative positions.

8. Apparatus as claimed in claim 1, wherein said structure includes guide means extending parallel to said axis and limiting said sharpener to rectilinear reciprocation with respect to the structure.

9. Apparatus as claimed in claim 8; and a stationary, helical guide for said follower means, said guide conforming to the helical orientation of said knives.

10. Apparatus as claimed in claim 9, wherein said structure further includes a pair of normally upright brackets at opposite ends of the reel, said guide means extending between said brackets.

* * * * *